US012173589B2

(12) United States Patent
Taha et al.

(10) Patent No.: US 12,173,589 B2
(45) Date of Patent: Dec. 24, 2024

(54) DOWNHOLE CATCHER FOR WELLBORE PLUNGER

(71) Applicant: Saudi Arabian Oil Company, Dhahran (SA)

(72) Inventors: Syed Muhammad Bin Syed Taha, Dhahran (SA); Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/988,171

(22) Filed: Nov. 16, 2022

(65) Prior Publication Data

US 2024/0159234 A1 May 16, 2024

(51) Int. Cl.
*F04B 47/12* (2006.01)
*E21B 43/12* (2006.01)

(52) U.S. Cl.
CPC ..... *E21B 43/121* (2013.01); *F04B 47/12* (2013.01)

(58) Field of Classification Search
CPC ..... F04B 47/12; E21B 43/121; E21B 34/08; E21B 34/106; E21B 34/142; E21B 34/14; E21B 2200/05
See application file for complete search history.

(56) References Cited

U.S. PATENT DOCUMENTS

2004/0251032 A1 12/2004 Luke et al.
2012/0080196 A1* 4/2012 Laing ..... E21B 43/121 166/369
2015/0000982 A1* 1/2015 McDowell ..... F16K 3/03 175/57

OTHER PUBLICATIONS

International Search Report and Written Opinion in PCT Appln. No. PCT/US2023/036762, mailed on Feb. 16, 2024, 15 pages.

* cited by examiner

*Primary Examiner* — Nicole Coy
*Assistant Examiner* — Nicholas D Wlodarski
(74) *Attorney, Agent, or Firm* — Fish & Richardson P.C.

(57) ABSTRACT

A downhole catcher for wellbore plunger includes an elongate, hollow body, a plunger catcher plate and a hydraulic actuation assembly. The body can be installed within a wellbore, and defines an interior volume through which a plunger of a plunger lift system can travel from the surface toward the subsurface reservoir. The plunger catcher plate is attached to a downhole end of the body. The plate can transition between a first and plate positions in which a plate axis is perpendicular to and parallel to the body axis, respectively. The plate can, in the second plate position, catch the plunger traveling from the surface toward the subsurface reservoir. The hydraulic actuation assembly is connected to the plunger catcher plate and can transition the plunger catcher plate from the first plate position to a second plate position in response to being hydraulically actuated.

10 Claims, 3 Drawing Sheets

DOWNHOLE CATCHER FOR WELLBORE PLUNGER

TECHNICAL FIELD

This disclosure relates to wellbore operations, for example, to recovering hydrocarbons through wellbores using enhanced oil recovery (EOR) techniques.

BACKGROUND

Hydrocarbons (e.g., oil, natural gas, combinations of them) trapped in a subsurface reservoir are raised to the surface (i.e., produced) through one or more wellbores formed from a surface of the Earth to the subsurface reservoir through a subterranean zone (e.g., a formation, a portion of a formation, multiple formations). To prepare a wellbore for production, the well is completed by installing well completions (i.e., well tools and associated hardware) within the wellbore. The hydrocarbons are pressurized by the subterranean zone in the subsurface reservoir such that, in primary hydrocarbon recovery operations, the pressure of the subterranean zone causes the hydrocarbons to flow from the subsurface reservoir through the wellbore to the surface. Over time, the pressure of the subterranean zone decreases. Then, artificial lift techniques are implemented to produce remaining hydrocarbons in the subsurface reservoirs. Plunger lift is an example of an artificial lift technique in which a plunger is dropped down a production string, and caused to reciprocate between uphole and downhole ends of the well. The reciprocating motion of the plunger drives hydrocarbons through the wellbore to the surface.

SUMMARY

This disclosure describes technologies relating to a downhole catcher for a wellbore plunger.

Certain aspects of the subject matter described here can be implemented as a well tool system that includes an elongate, hollow body, a plunger catcher plate and a hydraulic actuation assembly. The body can be installed within a wellbore that is formed from a surface of the Earth through a subterranean zone to a subsurface reservoir storing hydrocarbons. The body defines an interior volume through which a plunger of a plunger lift system can travel from the surface toward the subsurface reservoir. The plunger catcher plate is attached to a downhole end of the body. The plate can transition from a first plate position in which a plate axis is perpendicular to a body axis and a second plate position in which the plate axis is parallel to the body axis. The plate can, in the second plate position, catch the plunger traveling from the surface toward the subsurface reservoir. The hydraulic actuation assembly is connected to the plunger catcher plate. The hydraulic actuation assembly can transition the plunger catcher plate from the first plate position to a second plate position in response to being hydraulically actuated.

An aspect combinable with any other aspect includes the following features. The hydraulic actuation assembly includes an actuation sleeve that can translate within the interior volume along the body axis between a first sleeve position in which the plate is maintained in the first plate position and a second sleeve position in which the plate is allowed to translate to the second plate position.

An aspect combinable with any other aspect includes the following features. The hydraulic actuation assembly includes a plate spring that is connected to the plunger catcher plate and the body. In a biased state, the plate spring can maintain the plate in the first plate position. In an unbiased state, the plate spring can allow the plate to transition to the second plate position.

An aspect combinable with any other aspect includes the following features. The hydraulic actuation assembly includes a piston that can translate along the body axis between an energized position in which the actuation sleeve retains the plate spring in the biased state and a de-energized position in which the actuation sleeve permits the plate spring to transition to the unbiased state.

An aspect combinable with any other aspect includes the following features. The hydraulic actuation assembly includes a piston spring coupled to the piston. The piston spring is in a biased state when the piston is in the energized position. The piston spring can transition to an unbiased state to transition the piston from the energized position to the de-energized position.

An aspect combinable with any other aspect includes the following features. The well tool system includes a pin that can couple the actuation sleeve and the piston to cause the actuation sleeve to translate along the body axis in response to the piston translating between the energized position and the de-energized position.

An aspect combinable with any other aspect includes the following features. Each of the actuation sleeve and the piston define a respective notch to receive respective ends of the pin.

An aspect combinable with any other aspect includes the following features. The well tool system includes a hydraulic fluid pump that can be installed at a surface of the wellbore. A hydraulic control line is fluidically coupled to the hydraulic fluid pump and to the piston. The hydraulic fluid pump can flow and draw hydraulic fluid to and from, respectively, the piston through the hydraulic control line. A controller is operatively coupled to the hydraulic fluid pump. The controller includes one or more processors and a computer-readable medium storing instructions executable by the one or more processors to perform operations. The operations include, in one instant, transmitting a signal to the hydraulic fluid pump to flow the hydraulic fluid through the hydraulic control line to the piston. The operations include, in another instant, transmit another signal to the hydraulic fluid pump to draw fluid through the hydraulic control line from the piston.

An aspect combinable with any other aspect includes the following features. A sensor is operatively coupled to the controller and to the plate spring. The sensor can, in response to receiving a signal from the controller, cause the plate spring to transition from the biased state to the unbiased state.

Certain aspects of the subject matter described here can be implemented as a method. While recovering hydrocarbons using a plunger lift system through a wellbore formed from a surface of the Earth through a subterranean zone to the subsurface reservoir, hydraulic fluid is flowed from the surface to an open portion defined within an elongate, hollow body installed within the wellbody. The body defines an interior volume through which the plunger is configured to travel. In response to flowing the hydraulic fluid, a plunger catcher plate attached to a downhole end of the body is maintained in a first plate position in which a plate axis is perpendicular to a body axis. In response to receiving a signal to catch the plunger traveling in the downhole direction, hydraulic fluid is drawn out of the open portion. In response to drawing fluid out of the open portion, the plunger catcher plate is transitioned from the first plate position to a second plate position in which the plate axis is parallel to the body axis. In the second plate position, the plunger catcher plate catches the plunger traveling in the downhole direction.

An aspect combinable with any other aspect includes the following features. To maintain the plunger catcher plate in the first plate position, a plate spring, which is connected to the plunger catcher plate and body, is biased to a biased state in which the plate spring can maintain the plunger catcher plate in the first plate position.

An aspect combinable with any other aspect includes the following features. To transition the plunger catcher plate from the first plate position to the second plate position, the plate spring is unbiased from the biased state to an unbiased state in which the plate spring is configured to transition to the second plate position.

An aspect combinable with any other aspect includes the following features. The plate spring is placed in the biased state by translating an actuation sleeve within the interior volume defined by the body along the body axis in a downhole direction through the wellbore.

An aspect combinable with any other aspect includes the following features. To unbias the plate spring to the unbiased state, the actuation sleeve is translated within the interior volume in an uphole direction through the wellbore.

An aspect combinable with any other aspect includes the following features. Drawing the hydraulic fluid out of the open portion causes the actuation sleeve to translate within the interior volume in the uphole direction.

An aspect combinable with any other aspect includes the following features. The hydraulic fluid is flowed to the open portion and drawn from the open portion through a hydraulic control line fluidically coupling the open portion defined within the body to a hydraulic fluid pump installed at the surface of the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Artificial lift techniques implementing plungers (sometimes called plunger lift) are often used for wellbore artificial lift or well de-liquefaction. The plunger used in plunger lift is the component that functions to mechanically lift well fluid, e.g., hydrocarbons, from downhole locations to the surface. Certain plunger designs leverage the natural flow pressure of the wellbore to propel the plunger upwards to achieve hydrocarbon or well fluid displacement. Once the plunger reaches a maximum uphole location to which the plunger can travel (e.g., an uphole end of the wellbore), the plunger drops under gravity to begin the next cycle of artificial lift. During or after plunger lift operations, the plunger needs to be retrieved from within the wellbore, e.g., for periodic maintenance or to change plungers. One technique to do so is to deploy a plunger catcher at a surface. This disclosure describes techniques to deploy a plunger catcher at a downhole location, e.g., at or near a downhole end of the wellbore, specifically immediately uphole of a bumper spring that is used to reverse direction of the plunger from downhole travel to uphole travel.

Implementing the techniques described here allows catching plungers at downhole locations rather than uphole locations. Because the plunger is not caught at the surface of a wellbore, surface catching equipment need not be installed at the surface, thereby saving space at the surface. The techniques described here can be implemented as an alternative to catching plungers at the surface or in addition to doing so.

Figure 1A:
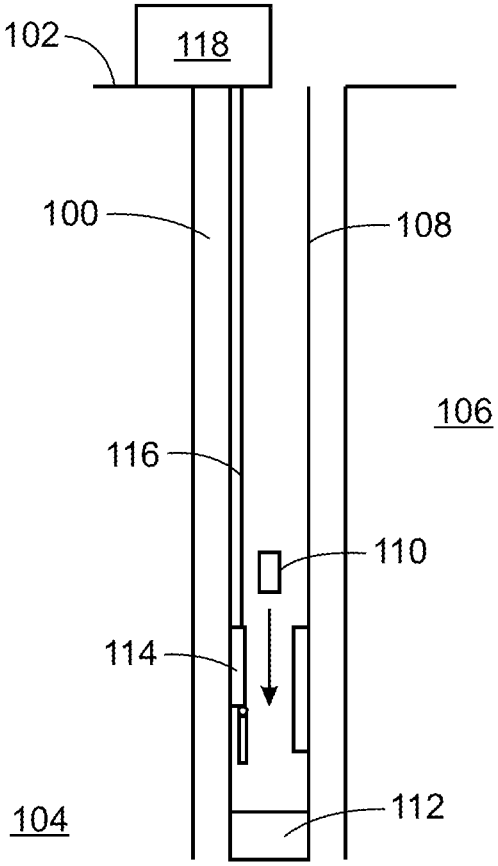
FIGS. 1A and 1B are schematic diagrams of a well system implementing plunger lift.
Figure 1B:
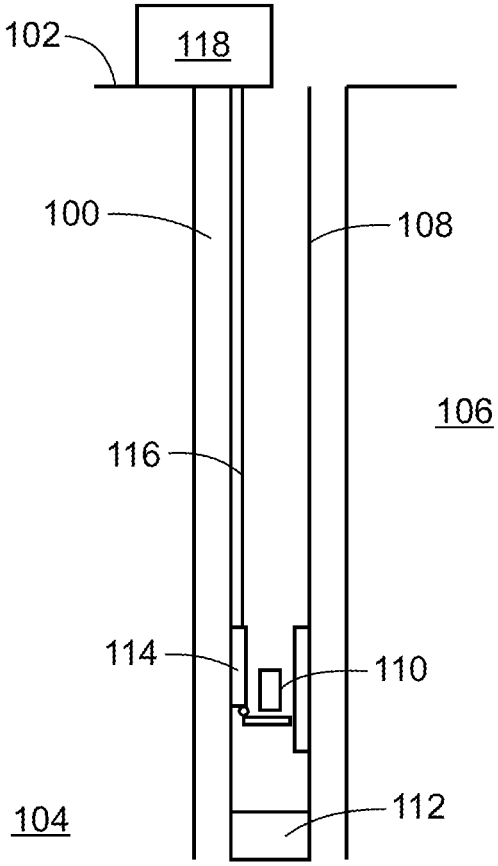

FIGS. 1A and 1B are schematic diagrams of a well system implementing plunger lift. The well system includes a wellbore 100 is formed from a surface 102 of the Earth to a subsurface reservoir 104 through a subterranean zone 106. Well fluids (not shown) including hydrocarbons in the subsurface reservoir 104 can be produced to the surface 102 through the wellbore 100. To do so, a production string 108 is installed within the wellbore 100. For example, the production string 108 can hang from a wellhead (not shown) installed at the entrance to the wellbore 100. In some implementations, artificial lift techniques are implemented in the wellbore 100 to produce the well fluids to the surface. Plunger lift is an example of such an artificial lift technique. To implement plunger lift, a plunger 110 is dropped into the wellbore 100 from the surface 102. By reciprocating between an uphole end and a downhole end of the wellbore 100, the plunger 110 can assist with lifting well fluids (e.g., the hydrocarbons) to the surface 102. The plunger 110 can travel in the downhole direction under gravity. A bumper spring 112 can be installed at the downhole end or at a downhole location within the wellbore 100. When the plunger 110 contacts the bumper spring 112, the plunger 110 reverses direction and begins to travel in an uphole direction.

As described in this disclosure, a plunger catcher assembly 114 is installed at a downhole location in the wellbore 100. For example, the plunger catcher assembly 114 is installed at the downhole end of the wellbore 100 or immediately uphole of the bumper spring 112. In a configuration shown in FIG. 1A, the plunger catcher assembly 114 does not interfere with travel of the plunger 110 in either the uphole or downhole direction. In this configuration, plunger lift operations utilizing the plunger 110 can continue without obstruction by the plunger catcher assembly 100.

When the plunger 110 is ready to be caught (e.g., to replace the plunger, to perform plunger maintenance or for any other reason), the configuration of the plunger catcher assembly 114 is changed to the one schematically shown in FIG. 1B. As described later, the configuration of the plunger catcher assembly 114 can be changed from the one schematically shown in FIG. 1A to that schematically shown in FIG. 1B using hydraulic fluid flowed to and from the plunger catcher assembly 114 through a control line 116. The hydraulic fluid is flowed from a hydraulic source 118 at the surface 102.

Once transitioned to the configuration schematically shown in FIG. 1B, the plunger catcher assembly 114 catches the plunger 110 at the downhole location within the wellbore 100 rather than at or near the surface 102 of the wellbore 100. The plunger catcher assembly 114 described in this disclosure can be deployed at any location within the wellbore 100 including at locations nearer to an uphole end of the wellbore 100. Specifically, the plunger catcher assembly 114 can be deployed anywhere within the wellbore 100 as long as all components of the plunger catcher assembly 114 (excluding the hydraulic source 118 (described later)) are within the wellbore 100 allowing the plunger 110 to be caught at a downhole end of the plunger catcher assembly 114 with minimal plunger catching components at the surface.

Figure 2A:
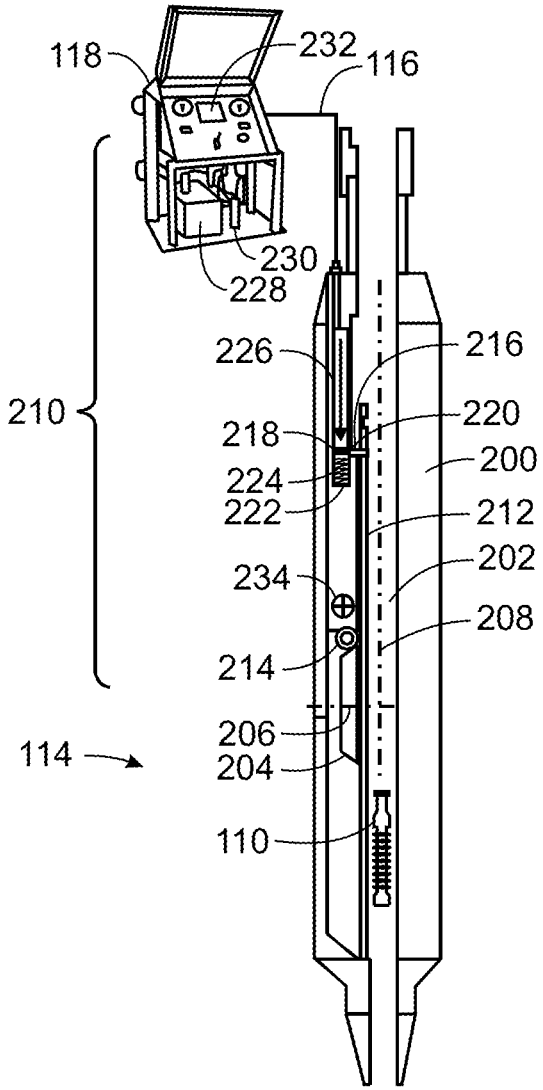
FIGS. 2A and 2B are schematic diagrams of a downhole plunger catcher assembly.
Figure 2B:
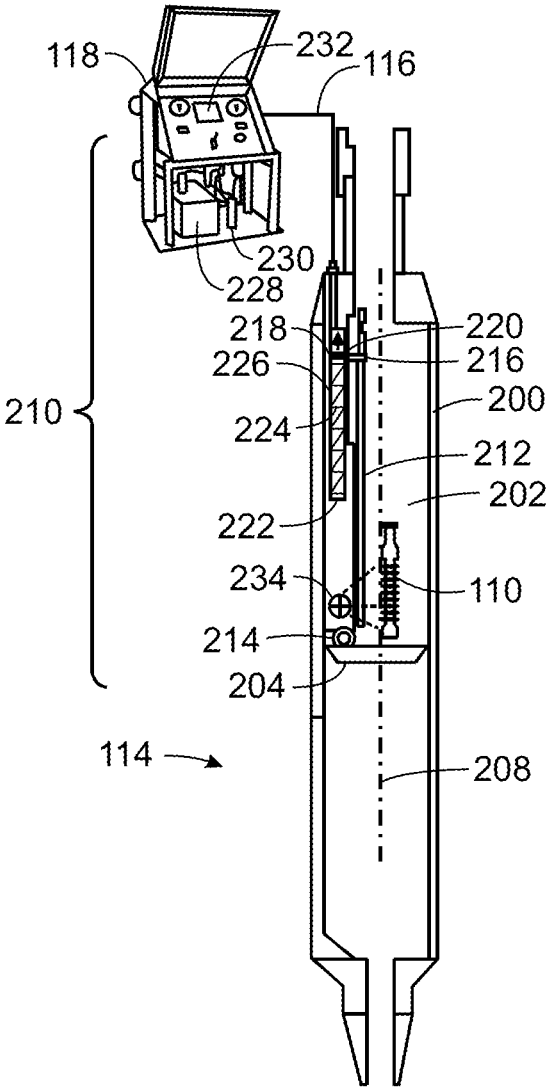

FIGS. 2A and 2B are schematic diagrams of the downhole plunger catcher assembly 114. The assembly 114 includes an elongate, hollow body 200 that is configured to be installed within the wellbore 100, specifically within the production string 108 nearer to a downhole end of the wellbore 100 than to an uphole end of the wellbore 100. The body 200 defines an interior volume 202 through which the plunger 110 is configured to travel from the surface 102 toward the subsurface reservoir 104 and to reciprocate back toward the surface 102. A plunger catcher plate 204 is attached to a downhole end of the body 200. The plate 204 can transition from a first plate position in which a plate axis 206 is substantially (or exactly) perpendicular to a body axis 208 to a second plate position in which the plate axis 206 and the body axis 208 are substantially (or exactly) aligned. In this context, "substantially perpendicular" means that the two axes are at an angle that is sufficient for the plate 204 to be sufficiently away from the internal volume 202 so as to not obstruct free reciprocation of the plunger 110 through the internal volume 202. And, "substantially aligned" means that the two axes are at an angle that is sufficient for the plate 204 to be sufficiently within the internal volume 202 so as to be able to catch the plunger 110 when the plunger travels in a downhole direction through the internal volume 202.

Figure 3:
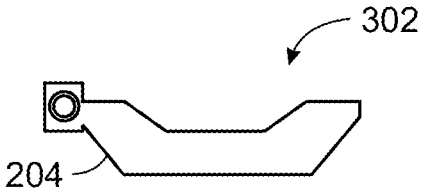
FIG. 3 is a schematic diagram of a plunger catcher plate used in the downhole plunger catcher of FIGS. 2A and 2B.

FIG. 3 is a schematic diagram of the plunger catcher plate 204. In some implementations, the plate 204 can include a profile with a bevel to automatically align with the plunger 110 during catching. A hinge 302 can couple the plate 204 to the body 200.

Returning to FIGS. 2A and 2B, the plunger catcher assembly 114 includes a hydraulic actuation assembly 114 connected to the plate 204. The hydraulic actuation assembly 114 is configured to transition the plate 204 from the first plate position schematically shown in FIG. 2A to the second plate position schematically shown in FIG. 2B. The hydraulic actuation assembly 114 includes an actuation sleeve 212 that can translate within the interior volume 202 along the body axis 208. That is, the actuation sleeve 212 can move in uphole and downhole directions. In particular, the actuation sleeve 212 can translate between a first sleeve position (FIG. 2A) in which the plate 204 is maintained in the first plate position, and a second sleeve position (FIG. 2B) in which the plate 204 is allowed to translate to the second plate position. In the first sleeve position, the actuation sleeve 212 is at a downhole location nearer to a downhole end of the body 200. In comparison, in the second sleeve position, the actuation sleeve 212 is uphole compared to the position of the actuation sleeve 212 in the first sleeve position.

The hydraulic actuation assembly 114 includes a plate spring 214 that is connected to the plate 204 and the body 200. The plate spring 214 can transition between a biased state in which the plate spring 214 maintains the plate 204 in the first plate position, and an unbiased state in which the plate spring 214 permits the plate 204 to transition to the second plate position. In some implementations, the plate spring 214 can be a helical spring. With the plate spring 214 in an unbiased state (i.e., without having been wound up), the plate 204 can be arranged in the second plate position (i.e., with the plate axis 206 and the body axis 208 substantially aligned), and each of the plate 204 and the body 200 can be connected to the plate spring 214. When the plate 204 is transitioned from the second plate position to the first plate position, in which the plate axis 206 and the body axis 208 are substantially perpendicular to each other, the plate spring 214 winds up and is biased.

The actuation sleeve 212 is installed in the first sleeve position nearer to the downhole end of the body 200. The bottom portion of the actuation sleeve 212 pushes the plate 204 to transition the plate to the first plate position and to bias the plate spring 214. A pin 216 couples the actuation sleeve 212 to the body 200 nearer to an uphole end of the actuation sleeve 212. To do so, the actuation sleeve 212 defines a notch 218 into which one end of the pin 216 is positioned. The other end of the pin 216 is positioned in a notch 220 defined by a piston 222, as described below.

The hydraulic actuation assembly 210 includes a piston that can translate along the body axis 208 between an energized position in which the actuation sleeve 212 pushes the plate 204 from the first plate position to the second plate position, thereby biasing the plate spring 214 and retaining the plate spring 214 in the biased state. With the pin 216 positioned in the notches 218 and 220 defined by the actuation sleeve 212 and the piston 222, respectively, the plate spring 214 remains in the biased state and the plate remains in the first plate position as long as the piston 222 remains energized.

The hydraulic actuation assembly 210 includes a piston spring 224 coupled to the piston 222. The piston spring 224 is in a biased state when the piston 222 is in the energized position. In some implementations, the piston spring 224 is a helical spring to the top of which the piston 222 (e.g., a plate) is attached. As described earlier, the notch 218 is formed on an edge of the piston 222. In the biased state, an axial force (i.e., a force along the body axis 208) is applied on the piston 222 causing the piston 222 to translate in the downhole direction within the body 200, and also causing the piston spring 224 to compress. Because the pin 216 connects the piston 222 and the actuation sleeve 212, the downhole translation of the piston 222 causes downhole translation of the actuation sleeve 212, which, in turn, applies the force on the plate 204 causing the plate to transition to the first plate position in which the plate spring 214 is biased.

When the piston 222 translates from the energized position to a de-energized position (described below), the translation of the piston 222 causes the actuation sleeve 212 to move in an uphole direction within the body 200 removing the force that holds the plate 204 in the first plate position. The force to transition the piston 222 to the energized position and to compress the piston spring 224 is applied by the hydraulic source 118 at the surface 102 of the wellbore 102. In some implementations, the body 200 defines an opening 226 (e.g., a chamber) that couples the control line 116 to the hydraulic source 118. The opening 226 can be a chamber formed within a side wall of the body 200 within which the piston 222 and the piston spring 224 are installed.

The hydraulic source 118 includes a hydraulic fluid reservoir 228, a hydraulic pump 230 and a controller 232. The controller 232 can be implemented as a computer system including one or more processors and a computer-readable medium storing instructions by the one or more processors to perform operations described here. Alternatively or in addition, the controller 232 can be implemented as processing circuitry, software, hardware, firmware or any combination of them with or without the computer system. In response to receiving signals from the controller 232, the hydraulic pump 230 can pump hydraulic fluid carried in the hydraulic fluid reservoir 228 into the opening 226 and draw the hydraulic fluid out of the opening 226. When the controller 232 sends a signal to the hydraulic pump 230 to pump the hydraulic fluid into the opening 226, then the piston 222 is translated in a downhole direction to the energized position and the piston spring 224 is compressed to its biased state. When the controller 232 sends a signal to the hydraulic pump 230 to draw the hydraulic fluid out of the opening 226, then the piston 222 is translated in an uphole direction to the de-energized position and the piston spring 224 is decompressed to its unbiased state.

In some implementations, the assembly 114 can include a sensor 234 which can be operatively coupled to the controller 232. When the plate 204 is in the first plate position and the plunger 110 reciprocates between uphole and downhole positions, the sensor 234 remains dormant. When the plunger 110 is ready to be caught, an operator can cause the controller 232 to transmit an instruction to the sensor 234. For example, in response to the instruction, the sensor 234, which is connected to the plate spring 214, can cause the plate spring 214 to transition from the biased state to the unbiased state. In some implementations, the assembly can operate to catch the plunger 110 without the sensor 234, and the sensor 234 can be used as a backup or as a redundant mechanism.

Figure 4:
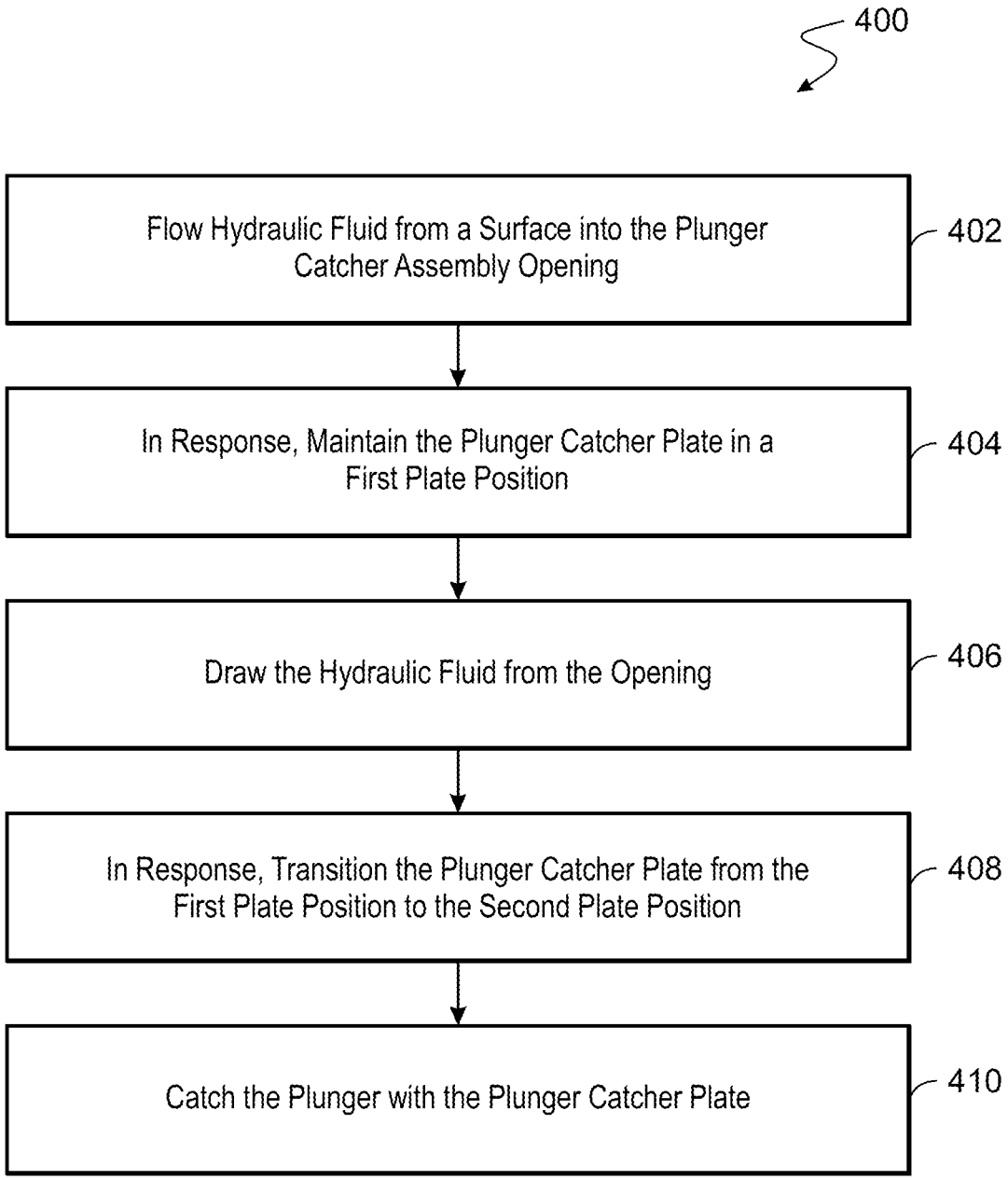
FIG. 4 is a flowchart of an example of a process of using the downhole plunger catcher of FIGS. 2A and 2B.

FIG. 4 is a flowchart of an example of a process 400 of using the plunger catcher assembly of FIGS. 2A and 2B. Prior to implementing the process 400, the plunger catcher assembly 114 is installed within the production string 108 at a downhole location, as described earlier. For example, the plunger catch assembly can be made up as a separate string connected to the end of the production string. Alternatively, the plunger catcher assembly can be installed within a production string using a packer or similar mechanism to affix the plunger catcher assembly to the inner wall of the production string.

When installed, the plate spring 214 is in an unbiased state meaning that the plate 204 is in the second plate position. The piston spring 224 is also in an unbiased state meaning that the piston 222 is in the de-energized position. At 402, hydraulic fluid is flowed from the surface 102 to the open portion (i.e., the opening 226) within the body 200. For example, at some instant, the controller 232 transmits a signal to the hydraulic pump 230 to pump the hydraulic fluid from the reservoir 228 into the opening 226. At 404, in response to flowing the hydraulic fluid, the plunger catcher plate 204 is maintained in a first plate position. Specifically, the pressure of the hydraulic fluid is sufficiently high to cause the piston 222 to travel downhole and compress the piston spring 224. The downhole movement of the piston 222 causes the actuation sleeve 212 to travel downhole within the body 200. The actuation sleeve 212 applies a force on the plate 204 causing the plate to either be maintained in the first plate position or to transition from a second plate position to a first plate position. As long as the pressure of the hydraulic fluid on the piston 222 remains, the actuation sleeve 212 holds the plate 204 in the first plate position.

At 406, the hydraulic fluid is drawn from the opening. For example, an operator of the plunger catcher assembly 114 operates the controller 232 to transmit a signal to the hydraulic pump 230 to draw the hydraulic fluid from the opening 226 back into the reservoir 228. At 408, in response to drawing the hydraulic fluid from the opening 226, the plunger catcher plate 204 transitions from the first plate position to the second plate position. Specifically, as the pressure of the hydraulic fluid on the piston 222 decreases, the piston spring 224 transitions from its biased state to an unbiased state. That is, the piston spring 224 expands pushing the piston 222 in the uphole direction. Because the piston 222 and the actuation sleeve 212 are coupled by the pin 216, the uphole movement of the piston 222 also causes uphole movement of the actuation sleeve 212. The actuation sleeve movement removes the biasing force on the plate spring 214 causing the spring 214 to move the plate 204 from the first plate position to the second plate position. At 410, the plate 204, in the second plate position, catches the plunger 110.

Thus, particular implementations of the subject matter have been described. Other implementations are within the scope of the following claims.

The invention claimed is:

1. A well tool system comprising:

an elongate, hollow body configured to be installed within a wellbore that is formed from a surface of the Earth through a subterranean zone to a subsurface reservoir storing hydrocarbons, the body defining an interior volume through which a plunger of a plunger lift system is configured to travel from the surface toward the subsurface reservoir;

a plunger catcher plate attached to a downhole end of the body, the plate configured to transition from a first plate position in which a plate axis is perpendicular to a body axis and a second plate position in which the plate axis is parallel to the body axis, the plate configured, in the second plate position, to catch the plunger traveling from the surface toward the subsurface reservoir;

a hydraulic actuation assembly connected to the plunger catcher plate, the hydraulic actuation assembly configured to transition the plunger catcher plate from the first plate position to a second plate position in response to being hydraulically actuated, wherein the hydraulic actuation assembly comprises an actuation sleeve configured to translate within the interior volume along the body axis between a first sleeve position in which the plate is maintained in the first plate position and a second sleeve position in which the plate is allowed to translate to the second plate position, wherein the hydraulic actuation assembly comprises a plate spring that is connected to the plunger catcher plate and the body, wherein, in a biased state, the plate spring is configured to maintain the plate in the first plate position, and wherein, in an unbiased state, the plate spring is configured to allow the plate to transition to the second plate position, wherein the hydraulic actuation assembly comprises a piston configured to translate along the body axis between an energized position in which the actuation sleeve retains the plate spring in the biased state and a de-energized position in which the actuation sleeve permits the plate spring to transition to the unbiased state, wherein the hydraulic actuation assembly comprises a piston spring coupled to the piston, wherein the piston spring is in a biased state when the piston is in the energized position, and wherein the piston spring is configured to transition to an unbiased state to transition the piston from the energized position to the de-energized position, and a pin configured to couple the actuation sleeve and the piston to cause the actuation sleeve to translate along the body axis in response to the piston translating between the energized position and the de-energized position, wherein each of the actuation sleeve and the piston define a respective notch to receive respective ends of the pin.

2. The well tool system of claim 1, further comprising:

a hydraulic fluid pump configured to be installed at a surface of the wellbore;

a hydraulic control line fluidically coupled to the hydraulic fluid pump and to the piston, the hydraulic fluid pump configured to flow and draw hydraulic fluid to and from, respectively, the piston through the hydraulic control line; and a controller operatively coupled to the hydraulic fluid pump, the controller comprising:

one or more processors, and a computer-readable medium storing instructions executable by the one or more processors to perform operations comprising:

in one instant, transmitting a signal to the hydraulic fluid pump to flow the hydraulic fluid through the hydraulic control line to the piston; and in another instant, transmitting another signal to the hydraulic fluid pump to draw fluid through the hydraulic control line from the piston.

3. The well tool system of claim 2, further comprising a sensor operatively coupled to the controller and to the plate spring, the sensor configured, in response to receiving a signal from the controller, to cause the plate spring to transition from the biased state to the unbiased state.

4. A method comprising:

while recovering hydrocarbons using a plunger lift system through a wellbore formed from a surface of the Earth through a subterranean zone to the subsurface reservoir, the plunger lift system including a plunger configured to travel in uphole and downhole directions through the wellbore:

flowing hydraulic fluid from the surface to an open portion defined within an elongate, hollow body installed within the wellbore, the body defining an interior volume through which the plunger is configured to travel;

in response to flowing the hydraulic fluid, maintaining a plunger catcher plate attached to a downhole end of the body in a first plate position in which a plate axis is perpendicular to a body axis;

in response to receiving a signal to catch the plunger traveling in the downhole direction, drawing hydraulic fluid out of the open portion; and in response to drawing fluid out of the open portion, transitioning the plunger catcher plate from the first plate position to a second plate position in which the plate axis is parallel to the body axis, wherein, in the second plate position, the plunger catcher plate catches the plunger traveling in the downhole direction.

5. The method of claim 4, wherein maintaining the plunger catcher plate in the first plate position comprises biasing a plate spring that is connected to the plunger catcher plate and the body to a biased state in which the plate spring is configured to maintain the plunger catcher plate in the first plate position.

6. The method of claim 5, wherein transitioning the plunger catcher plate from the first plate position to the second plate position comprises unbiasing the plate spring from the biased state to an unbiased state in which the plate spring is configured to transition to the second plate position.

7. The method of claim 6, further comprising placing the plate spring in the biased state by translating an actuation sleeve within the interior volume defined by the body along the body axis in a downhole direction through the wellbore.

8. The method of claim 7, wherein unbiasing the plate spring to the unbiased state comprises translating the actuation sleeve within the interior volume in an uphole direction through the wellbore.

9. The method of claim 8, wherein drawing the hydraulic fluid out of the open portion causes the actuation sleeve to translate within the interior volume in the uphole direction.

10. The method of claim 4, wherein the hydraulic fluid is flowed to the open portion and drawn from the open portion through a hydraulic control line fluidically coupling the open portion defined within the body to a hydraulic fluid pump installed at the surface of the wellbore.

* * * * *